US006648601B2

(12) United States Patent
Williams

(10) Patent No.: US 6,648,601 B2
(45) Date of Patent: Nov. 18, 2003

(54) LABYRINTH SEAL FOR FAN ASSEMBLY

(75) Inventor: Edward Williams, St. Louis, MO (US)

(73) Assignee: Good Earth Tools, Inc., Crystal City, MO (US)

( * ) Notice: Subject to any disclaimer, the term of this patent is extended or adjusted under 35 U.S.C. 154(b) by 70 days.

(21) Appl. No.: 09/989,842

(22) Filed: Nov. 19, 2001

(65) Prior Publication Data

US 2003/0095868 A1 May 22, 2003

(51) Int. Cl.[7] ..... F04D 29/08

(52) U.S. Cl. ..... 416/186 R; 416/224

(58) Field of Search ..... 416/224, 186 R, 416/146 R, 229 R, 230, 241 R, 241 B

(56) References Cited

U.S. PATENT DOCUMENTS

| | | | | |
|---|---|---|---|---|
| 1,985,705 A | * | 12/1934 | Whiton, Jr. | 416/224 X |
| 4,671,740 A | * | 6/1987 | Ormiston et al. | 416/224 X |
| 4,721,313 A | | 1/1988 | Pennink | |
| 4,884,820 A | | 12/1989 | Jackson et al. | |
| 5,244,216 A | | 9/1993 | Rhode | |
| 5,423,660 A | | 6/1995 | Sortor | |
| 5,925,955 A | | 7/1999 | Norris | |

* cited by examiner

*Primary Examiner*—Edward K. Look
*Assistant Examiner*—Richard A. Edgar
(74) *Attorney, Agent, or Firm*—Dawn C. Wolff; Storm & Hemingway, L.L.P.

(57) ABSTRACT

Attaching a labyrinth seal composed of wear-resistant material to the surfaces of rotating equipment subject to wear can increase the life of the rotating equipment and reduce downtime for equipment maintenance and repairs.

21 Claims, 3 Drawing Sheets

LABYRINTH SEAL FOR FAN ASSEMBLY

BACKGROUND OF THE INVENTION

In rotating machines, such as turbines, power expanders, power plant fans, pumps, and the like, a fluid, such as a liquid or gas is often rotated through the machine. Frequently, the liquid or gas component contains suspended solids. When these solids strike against the exposed surfaces of the machine, it can cause accelerated wear on the machine surfaces. This wear generally does not occur evenly, and greater wear is seen in areas where the solids are projected against the surface, or currents or eddies form in the gas or liquid stream, retaining a portion of the stream in contact with part surfaces for an extended time. Often, the solid material will completely wear away the machine parts, necessitating repair or replacement of the worn parts. Often, these assemblies are located deep inside machinery, and the entire system must be shut down and dismantled to gain access to worn parts. A longer time duration between machine shutdowns, which increases productivity and reduces down time, is desirable in these circumstances.

One solution to this wear problem has been to place a coating or liner on the exposed surfaces which are subject to wear to slow or reduce the wear. When the liners on the areas more subject to wear have deteriorated, they can be replaced, eliminating the need to replace the entire part. However, thin coatings which are sprayed or painted on are often insufficient to slow wear significantly enough to warrant the expense and time of coating. Another solution has been to construct the rotating equipment of a material that is more resistant to wear. However, this tends to be cost-prohibitive because such materials are generally expensive, and are only needed in areas where there is actual contact of the solids with the surface. Yet another solution has been to attach a solid layer of wear-resistant material to the areas of the machinery that experience wear, or etching. However, difficulties have occurred with finding a means to adhere the wear-resistant material to the wear areas of the rotating equipment that will provide sufficient adhesion during operation of the equipment, but that can be removed when it becomes necessary to replace the wear-resistant material. Additionally, when a solid layer has been attached, difficulties have occurred with the solid material experiencing cracking or fracture failures when the machine starts or stops because the solid material is not flexible enough to withstand the torque applied during starting and stopping.

Therefore, what is needed is a means to slow or reduce wear in the areas of rotating equipment which see the greatest wear that is of sufficient durability that the equipment can go for long periods between replacement of the wear-resisting means, while finding a material that will not experience fractures during machine starts and stops.

BRIEF SUMMARY OF THE INVENTION

Labyrinth seals are formed by layering, or lapping materials in a way to deflect or slow the flow of materials, or minimize leakage of materials through the seal. Labyrinth seals are frequently employed when it is desired to keep materials in, or out of, certain areas of equipment, such as keeping gases out of areas where sparks are generated, or keeping solids away from rotating drive shafts where the solids could accumulate, and slow or stop rotation, or damage the shafts by wear.

The present invention involves attaching a labyrinth seal to high wear areas in rotating machines to slow or reduce wear. The irregularly shaped adjacent edges where the material is lapped help to alter the normal turbulence paths across the surface of the rotating equipment, and thus reduce wear. Additionally, in areas that involve junctions of two parts, where the greatest amount of wear is generally seen, an additional layer of labyrinth seal can be attached to the joint areas to slow or reduce wear in these areas even further. Because the labyrinth seal is comprised of individual tiles, the seal has sufficient flexibility to move slightly and therefore withstand cracking or fracturing when the fan is started and stopped.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
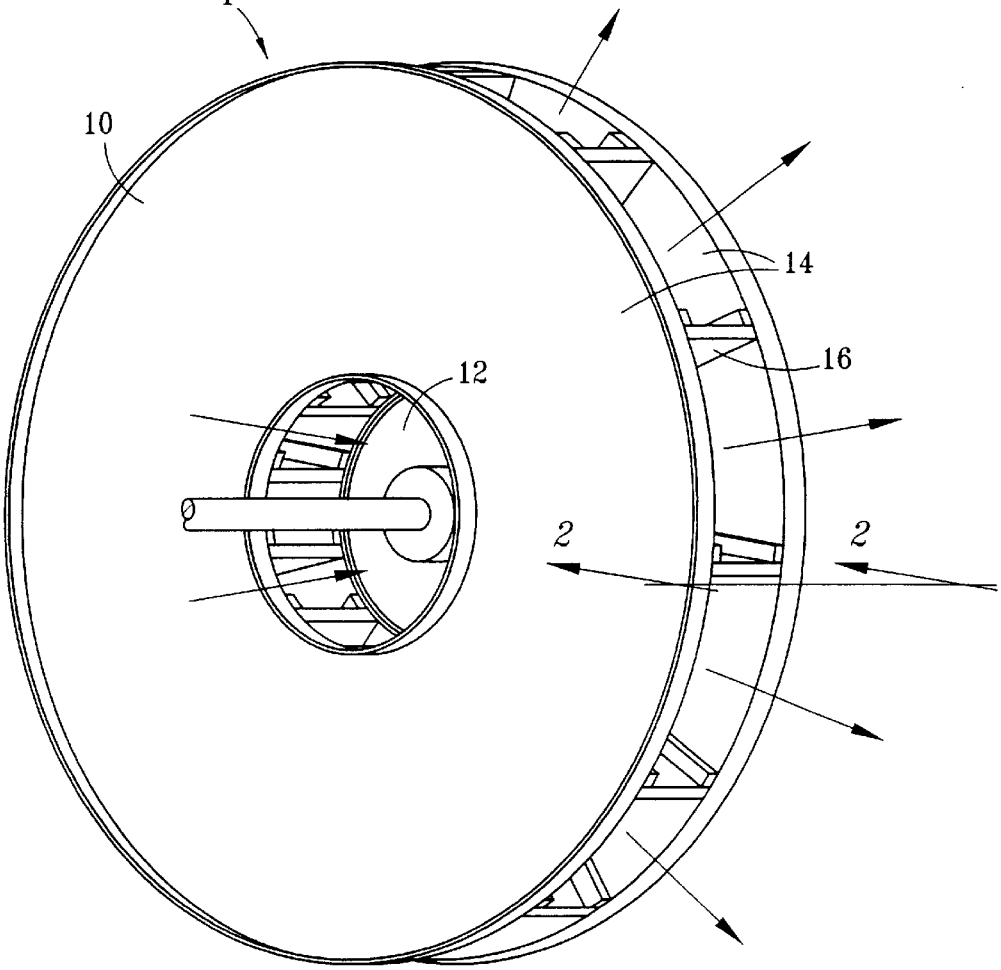
FIG. 1 is a perspective view of an installation of a coal-fired power system fan embodying features of the present invention.

In the discussion of the FIGURES the same reference numerals will be used throughout to refer to the same or similar components. In the interest of conciseness, various components known to the art, such as motors, combustion chambers, and the like, have not been shown or discussed. One arrangement of the present invention, the installation of a labyrinth seal on a fan in a coal-fired power plant, is depicted and described herein. It can be appreciated by those skilled in the art that other arrangements and uses for the present invention not described in detail herein are also included within the scope of the present invention.

FIG. 1 shows an embodiment of the present invention, the installation of a labyrinth seal on portions of the fan in a coal-fired power plant. The reference numeral 1 generally designates a fan system assembly embodying features of the present invention. The system 1 includes a fan 10, defining a non-sealed hub 12, and two sides 14 comprising the outer perimeter of the fan. The fan also has a number of fan blades 16 that extend from the hub to the outside circumference of the fan that are secured between the two sides 14 of the fan. Gas or liquid and suspended coal particles are drawn into the hub 12 of the fan 10, and are projected out the circumference of the fan.

Figure 2:
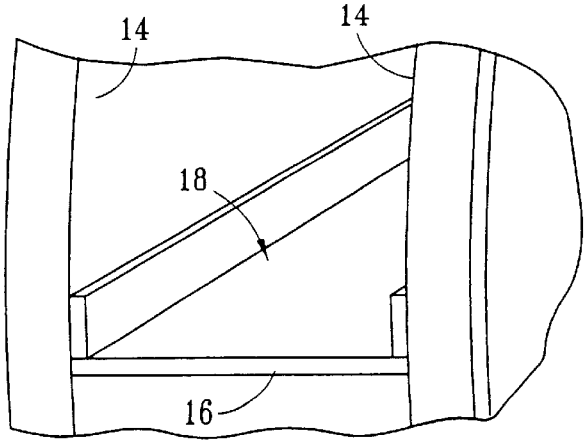
FIG. 2 is a side elevation view of the system of FIG. 1 taken along the line 2—2 of FIG. 1.

As shown in FIG. 2, channels 18 are formed by the fan blade 16 and fan sides 14. When the gas or liquid containing solid particles flows through the channels 18 of the fan 10, turbulence occurs, and increased wear areas are seen, particularly along the channel edges, where the solids tend to accumulate out of the flow stream. The extended contact of the particles against these surfaces causes the surfaces to wear away more quickly.

The areas subject to increased wear will vary based on the liquid or gas being projected through the channels 18, and the solids within that liquid or gas. By knowing where the greatest turbulence will occur in a particular machine, a labyrinth seal 100 can be designed and installed to minimize wear created by the friction. When the friction is reduced, wear in those areas is also reduced, resulting in a seal or liner that does not wear as quickly in those high stress areas. Because the seals slow part wear, decreased down time for replacement of seals or machine parts results.

Figure 3:
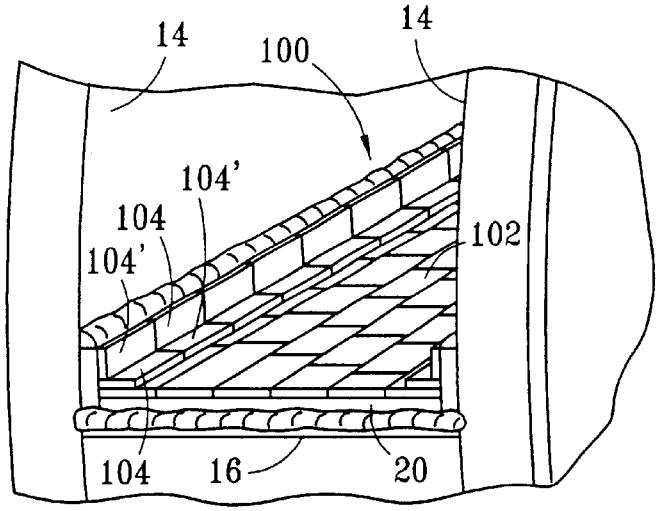
FIG. 3 shows an expanded view of one arrangement of a labyrinth seal of the present invention fully installed on a fan blade.
Figure 4:
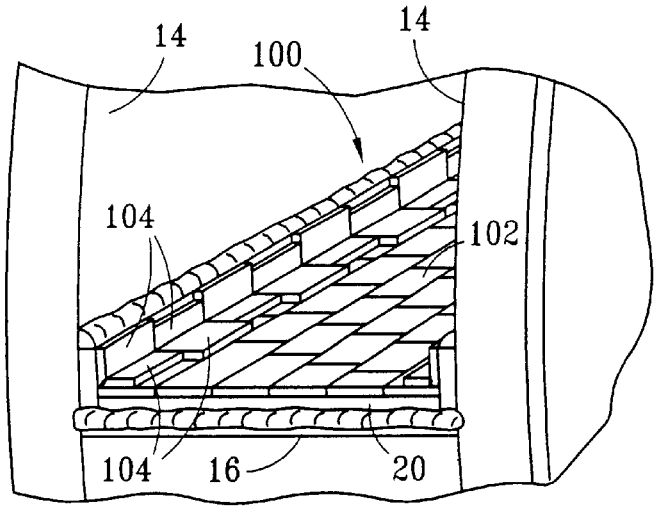
FIG. 4 shows an expanded view of an alternative arrangement of a labyrinth seal of the present invention fully installed on a fan blade.

As shown in FIGS. 3 and 4, a labyrinth seal 100 can be attached along the surfaces of the fan blades 16 and fan sides 14 which are struck most frequently by the suspended particles to reduce the wear. The labyrinth seal 100 is comprised of a series of plates 102 securely attached to the fan sides 14 and the face of the fan blade 16 or a substrate 20 that is secured to the face of the fan blade 16. The seal extends to cover the surfaces with which the gas or liquid and suspended particles come in contact and cause wear.

The plates may be attached by brazing or soldering, or by other methods such as the use of an epoxy material, depending on the material composition of the plates 102, the fan blade 16, and fan sides 14. The material compositions and attachment methods also determine if a substrate 20 should be inserted between the plates 102 and the fan blade 16. The seal is comprised of a series of plates 102, rather than a single sheet of material, because the edges of the plates 102 tend to reduce the turbulence of the gas or liquid across the surface of the seal 100 by breaking up the flow, whereas a single smooth surface would increase the flow speed, causing additional wear on the labyrinth seal 100. Additionally, individual plates can move slightly in relation to each other, therefore withstanding the torque experienced when the fan starts or stops without cracking or fracturing such as a single large surface might experience.

The labyrinth seal 100 is further comprised of a series of tiles 104 secured along the area of the channels 18 where the fan blade 16 and the fan sides 14 are joined. Because this is the area of the fan 10 subject to the most wear, the labyrinth seal 100 in this area must reduce the friction wear caused by the solids in the gas or liquid stream more than in other areas in the fan 10. The extra layer of tiles 104 in the labyrinth seal 100 creates a surface that causes turbulence that breaks up the gas or liquid stream flow, and therefore slows down the speed of the gas or liquid, and the speed of the suspended particles. Because the particles contact the surfaces at a slower speed, the wear in these areas is reduced such that it approximates to the wear in the other areas of the labyrinth seal 100. Additionally, like the plates, the individual tiles can move slightly in relation to each other, therefore withstanding the torque experienced when the fan starts or stops without cracking or fracturing such as a single large surface might experience.

The tiles 104 are preferably of the same width and thickness. In one arrangement of the present invention, as depicted in FIG. 3, tile 104 is preferably of a length that is longer than tile 104' by an amount equal to the thickness of the tiles. This enables creation of a sealed area that has even edges by alternating tiles when installed as described below. In an alternative arrangement of the present invention, as depicted in FIG. 4, the tiles 104 are all of approximately the same length. When the seal is assembled, the edges are uneven. This type of arrangement of tiles is typically used when it is necessary to reduce the flow stream turbulence further to diminish wear.

The tiles 104 are preferably laid side by side along the surface of the fan blade 16, and another row of tiles 104 is preferably positioned side by side along the edge of the fan side 14. These tiles 104 are secured to the edge of the fan blade 16 where it joins the fan sides 14 in such a manner that the components project out beyond the rest of the plates 102 along the area where the fan blade 16 and fan sides 14 are joined.

Figure 5:
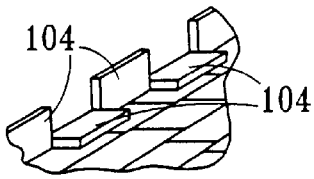
FIG. 5 is an expanded view of one arrangement of a labyrinth seal of the present invention partially mounted on a fan blade during construction of the labyrinth seal.
Figure 6:
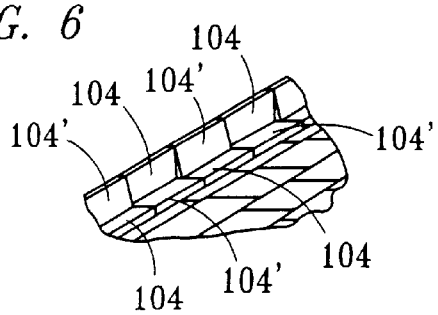
FIG. 6 is an expanded view of one arrangement of a labyrinth seal of the present invention mounted on a fan blade during construction of the labyrinth seal.

As shown in detail in FIGS. 5 and 6, in one arrangement of the present invention, tile 104 is of a greater length than tile 104'. One tile 104 is positioned on the fan blade 16 such that the end of the tile 104 abuts the fan side 14, and the corresponding shorter tile 104' positioned along the fan side 14, has the end abutting tile 104. Each adjacent set of tiles are preferably positioned in an alternating pattern such that an end of the longer tile 104, positioned on the fan side 14 abuts the fan blade 16, and the corresponding shorter tile 104', positioned along the fan blade 16 has an end abutting tile 104. This produces edges and seams that form a path along which the gas or liquid stream flows.

Figure 7:
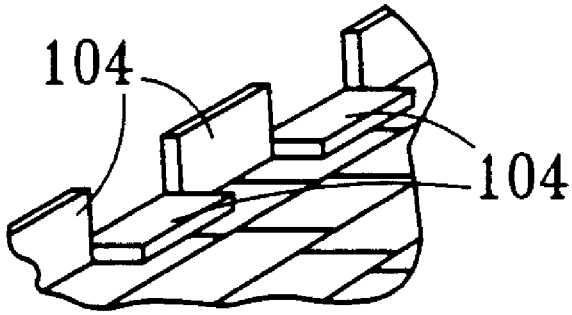
FIG. 7 is an expanded view of an alterative arrangement of a labyrinth seal of the present invention partially mounted on a fan blade during construction of the labyrinth seal.
Figure 8:
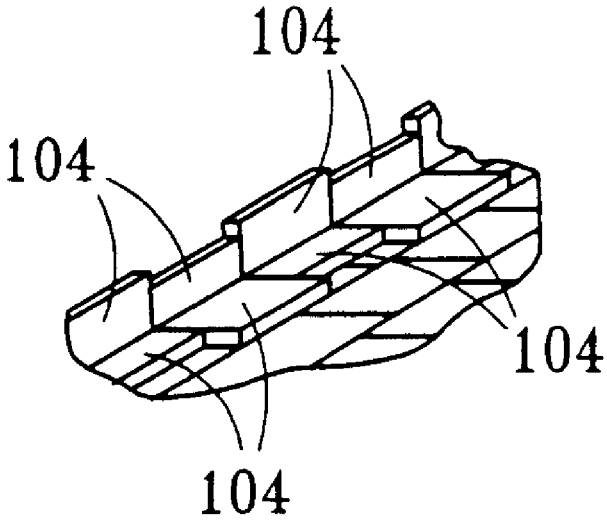
FIG. 8 is an expanded view of an alternative arrangement of a labyrinth seal of the present invention mounted on a fan blade during construction of the labyrinth seal.

As shown in detail in FIGS. 7 and 8, in an alternative arrangement of the present invention, all tiles 104 are of the same length, width, and height. One tile 104 is positioned on the fan blade 16 such that its end abuts the fan side 14, and the corresponding tile 104 positioned along the fan side 14, has the end abutting first tile 104. Each adjacent set tiles 104 are positioned such that the end of the first tile 104, positioned on the fan side 14 abuts the fan blade 16, and the corresponding tile 104 positioned along the fan blade 16 has the end abutting the first tile 104. This produces edges and seams that are not smooth, and form a tortuous path along which the air stream flows.

Typically, the labyrinth seal 100 is composed of a wear-resistant material, such as a metal carbide or ceramic. Such a material is more resistant to the wear caused by the striking of suspended particles, and thus further increases the life of the fan 10. Because such materials tend to be more expensive than steel or aluminum alloys, it is more economically feasible to make the entire fan out of a less expensive material, and only attach the more expensive wear-resistant seal material to those parts which are subject to wear.

It is understood that the present invention can take many forms and embodiments. Accordingly, several variations may be made in the foregoing without departing from the spirit or the scope of the invention.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A rotating fan made of a first material having a hub through which a gas containing solid particles is drawn, the gas and solid particles being projected out the circumference of the fan along channels formed by fan blades and fan sides, the channels being lined with a labyrinth seal comprised of:

a.) a layer of plates secured to at least a face of each fan blade wherein said plates are comprised of a second material harder than the first material; and b.) a second layer comprised of tiles of the second material secured along the length of at least one joint of the channel, the tiles being arranged with respect to each other to create irregular seams that cause turbulence and slow the rate at which the gas and solid particles are projected through the channels;

the plates and tiles being capable of flexible movement in relation to other plates and tiles, such that the plates and tiles can withstand torque experienced with movement of the fan without cracking or fracturing.

2. A method for forming a protective labyrinth seal on at least some exposed areas of a rotating fan having a hub, sides and at least one fan blade, the method comprising:

a) securing plates comprised of a hardened material to at least one face of each fan blade;

b) affixing an additional layer of tiles of the hardened material having a face length, a side width, and an edge depth along at least one intersection of the fan side and the fan blade such that:

a first face of a first tile is adjacent to the fan side and a first edge of the first tile is adjacent to the plates on the face of the fan blade;

a first face of a second tile is adjacent to the plates on the face of the fan blade, a first edge of the second tile is adjacent to the side of the fan blade, and a portion of a first side of the second tile is adjacent to a first side of the first tile;

a first face of a third tile is adjacent to the plates on the face of the fan blade, a first edge of the third tile is adjacent to a second face of the first tile, and a portion of a first side of the third tile is adjacent to the first side of the second tile;

a first face of a fourth tile is adjacent to the side of the fan, a first edge of the fourth tile is adjacent to a second face of the second tile, and a portion of a first side of the fourth tile is adjacent to a first side of the first tile; and c) alternating the above configuration along the entire intersection of the fan side and the fan blade.

3. The method of claim 2 wherein the plates and tiles are composed of a metal carbide.

4. The method of claim 2 wherein the plates and tiles are composed of a ceramic material.

5. The method of claim 2 further comprising securing the plates and tiles to the fan by means of an adhesive substance.

6. The method of claim 2 further comprising securing the plates and tiles to the fan by means of brazing.

7. The method of claim 2 further comprising securing a substrate between the fan blade and the plates.

8. The method of claim 7 further comprising securing the plates to the substrate and the substrate to the fan blade by means of an adhesive substance.

9. The method of claim 7 further comprising securing the plates to the substrate and the substrate to the fan blade by means of brazing.

10. The method of claim 2 further comprising sealing along all exposed edges of the tiles and plates adjoining the fan blade and fan side.

11. The method of claim 2 wherein all tiles are of approximately a same length.

12. The method of claim 2 wherein the length of the third and fourth tiles is shorter than the length of the first and second tiles by an amount approximately equal to a thickness of the tiles so that the edges of the tiles projecting out from the joint are of approximately a same height.

13. An apparatus for protecting at least one surface of a rotating fan having a hub, sides and at least one fan blade, the apparatus comprising:

a) plates comprised of a hardened material secured to at least a face of each fan blade;

b) a layer of tile comprised of the hardened material secured to an intersection of the fan side and the fan blade, each tile having a face length, a side width and an edge depth secured to the fan, the tile arranged such that:

a first tile is secured to the fan with a first face adjacent to the side of the fan and a first edge adjacent to the plates on the face of the fan blade;

a second tile is secured to the fan with a first face adjacent to the plates on the face of the fan blade, a first edge adjacent to the side of the fan blade, and a portion of a first side of the second tile adjacent to a first side of the first tile;

a third tile is secured to the fan with a first face adjacent to the plates on the face of the fan blade, a first edge adjacent to a second face of the first tile, and a portion of a first side of the tile adjacent to the first side of the second tile;

a fourth tile is secured to the fan with a first face adjacent to the side of the fan, a first edge adjacent to a second face of the second tile, and a portion of the first side of the tile adjacent to the first side of the first tile; and c) tiles configured in accordance with step b secured along the entire length of the joint of the fan blade and fan side.

14. The apparatus of claim 13 wherein all tiles are of approximately a same length.

15. The apparatus of claim 13 wherein the length of the third and fourth tiles is shorter than the length of the first and second tiles by an amount approximately equal to a thickness of the tiles so that the edges of the tiles projecting out from the joint are of approximately a same height.

16. The apparatus of claim 13 wherein the pieces of hardened material are secured to the assembly by means of an adhesive substance.

17. The apparatus of claim 13 wherein the pieces of hardened material are secured to the assembly by means of brazing.

18. The apparatus of claim 13 further comprising a substrate between the assembly and the plates of hardened material.

19. The apparatus of claim 18 wherein the plates of hardened material are secured to the substrate, and the substrate to the assembly by means of an adhesive substance.

20. The apparatus of claim 18 wherein the plates of hardened material are secured to the substrate, and the substrate to the assembly by means of brazing.

21. The apparatus of claim 13 wherein all exposed edges of the tiles and plates adjoining the fan blade and fan sides are sealed.

* * * * *